United States Patent [19]

Harwood et al.

[11] Patent Number: 4,759,423

[45] **Date of Patent: * Jul. 26, 1988**

[54] TUBE AND CHAMBER CONSTRUCTION FOR AN EXHAUST MUFFLER

[75] Inventors: Jon W. Harwood; Bruno A. Rosa; James W. Emrick, all of Toledo, Ohio; Perry A. Main, Erie, Mich.

[73] Assignee: AP Industries, Inc., Toledo, Ohio

[ * ] Notice: The portion of the term of this patent subsequent to Oct. 20, 2004 has been disclaimed.

[21] Appl. No.: 61,913

[22] Filed: Jun. 11, 1987

[51] Int. Cl.[4] ..... F01N 1/02; F01N 7/18

[52] U.S. Cl. ..... 181/282; 181/250; 181/266; 181/272

[58] Field of Search ..... 181/239, 241–255, 181/266–269, 272, 276, 282

[56] References Cited

U.S. PATENT DOCUMENTS

| | | | |
|---|---|---|---|
| 2,484,827 | 10/1949 | Harley . | |
| 2,860,722 | 11/1958 | Gerstung . | |
| 2,943,695 | 7/1960 | Jeffords | 181/243 |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,638,756 | 2/1972 | Thiele | 181/245 |
| 4,108,274 | 8/1978 | Snyder | 181/229 |
| 4,132,286 | 1/1979 | Hasui et al. | 181/265 |
| 4,396,090 | 8/1983 | Wolfhugel | 181/282 |
| 4,456,091 | 6/1984 | Blanchot | 181/282 |
| 4,700,806 | 10/1987 | Harwood | 181/282 |

FOREIGN PATENT DOCUMENTS

| | | |
|---|---|---|
| 59-155528 | 9/1984 | Japan . |
| 59-43456 | 12/1984 | Japan . |
| 61-155625 | 3/1985 | Japan . |
| 60-111011 | 6/1985 | Japan . |
| 61-14565 | 5/1986 | Japan . |
| 61-108821 | 5/1986 | Japan . |
| 632013 | 1/1950 | United Kingdom . |
| 1012463 | 12/1965 | United Kingdom . |
| 2120318 | 11/1983 | United Kingdom . |

*Primary Examiner*—B. R. Fuller

*Attorney, Agent, or Firm*—Anthony J. Casella; Gerald E. Hespos

[57] ABSTRACT

A muffler is provided including a pair of internal plates formed to define an array of tubes. At least one external shell is formed to define at least one chamber which will surround and enclose a selected portion of the array of tubes. Selected portions of certain tubes will be formed to include perforations. Portions of certain tubes will further undergo cross-sectional changes to control the flow of exhaust gases through the muffler. Certain channels between adjacent chambers of the external shell will be disposed to extend substantially continuously from peripheral portions of the adjacent chambers formed in the external shell. In certain embodiments, a controlled communication is provided between a low frequency resonating chamber and an adjacent expansion chamber. In other embodiments, additional formed layers are provided to enhance either heat or noise insulation.

26 Claims, 3 Drawing Sheets

FIG.1
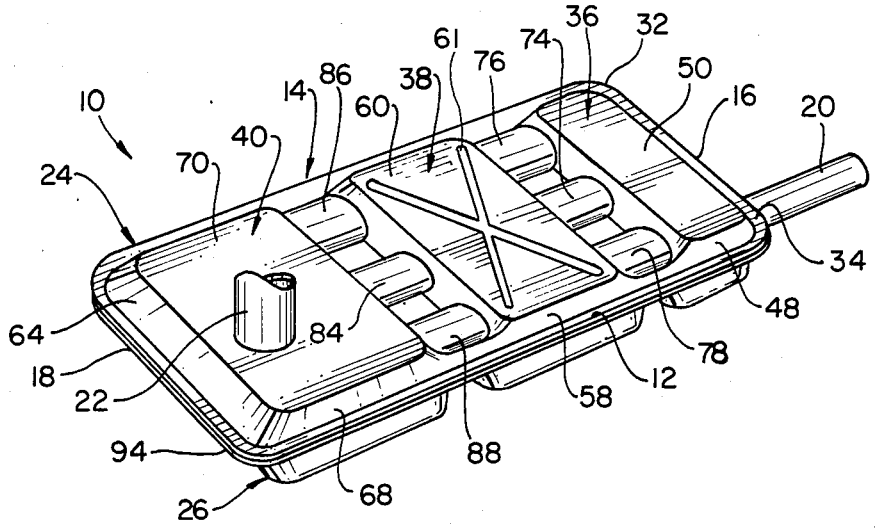
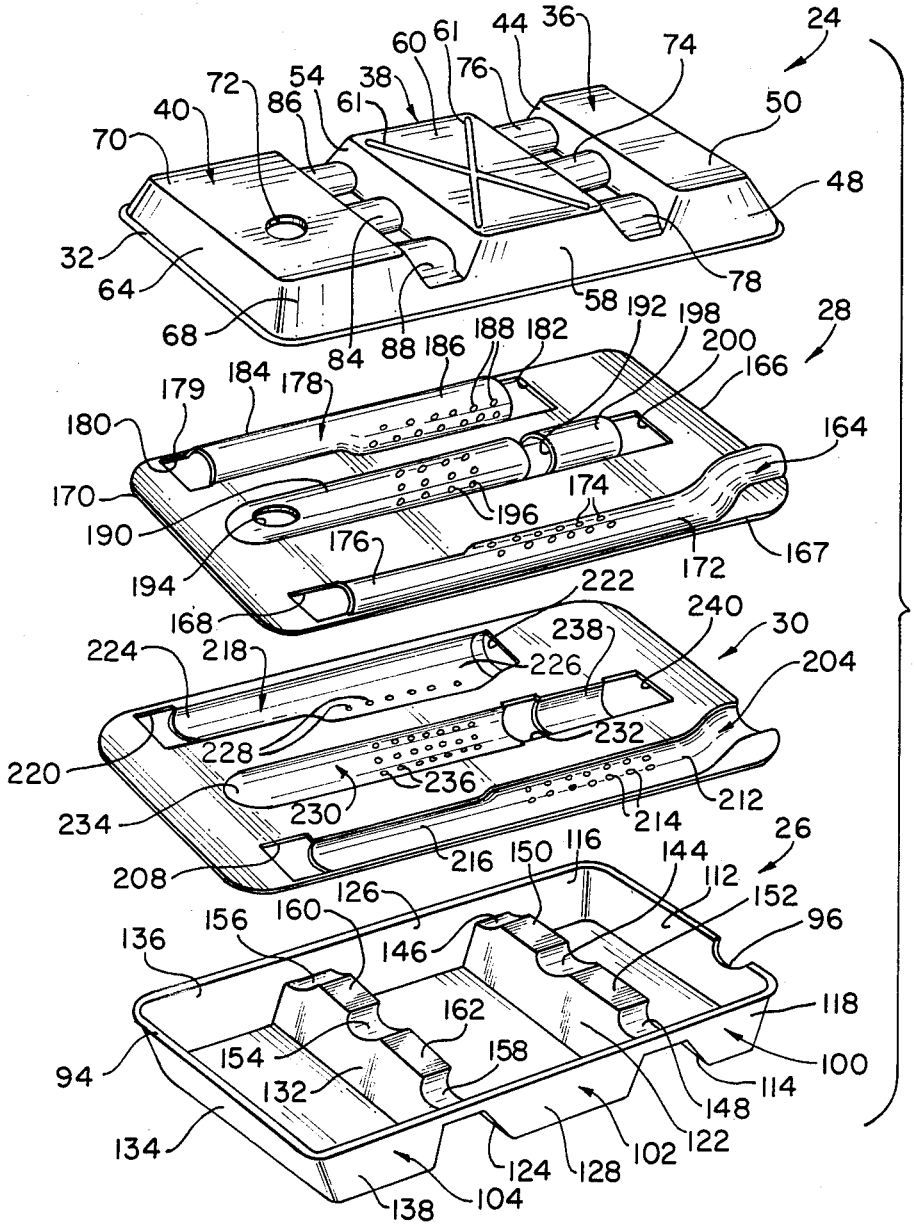
FIG. 2

TUBE AND CHAMBER CONSTRUCTION FOR AN EXHAUST MUFFLER

RELATED APPLICATIONS

This application is related to U.S. patent application Ser. No. 934,642 filed Nov. 25, 1986, now U.S. Pat. No. 4,700,806, entitled "STAMP FORMED MUFFLER" by Jon Harwood and U.S. patent application Ser. No. 061,876 filed concurrently with this application and entitled "EXHAUST MUFFLER WITH ANGULARLY ALIGNED INLETS AND OUTLETS" by Jon Harwood et al. Both of said co-pending applications are assigned to the assignee of the subject application. The disclosures of these co-pending applications are incorporated herein by reference.

BACKGROUND OF THE INVENTION

The typical prior art exhaust muffler comprises a plurality of parallel tubes supported by an array of transverse baffles. The tubes and baffles are disposed in a tubular shell formed by one or more sheets of metal. The shell typically is of oval or circular cross section and is aligned parallel to the tubes therein. The shell abuts the similarly shaped baffles to define chambers within the prior art muffler. Heads are mechanically attached or welded to the opposed ends of the shell and tubular nipples extend through the heads to provide communication with the tubes and chambers in the prior art muffler.

The tubular components of the prior art muffler define a carefully engineered flow path for exhaust gases. For example, many prior art mufflers include an inlet tube that extends into a reversing chamber defined by the baffles and the shell, while a return tube extends from the same reversing chamber to enable the exhaust gases to undergo a 180° change in direction. In many instances, two or more tubes extending through a chamber are perforated. Thus, while a primary flow of exhaust gas travels axially through the tubes, a secondary generally radially directed flow is established out the perforations of one tube, through the chamber and into the perforations of another tube. The proportional distribution between the axial flow through the tube and the radial flow through the perforations depends on the flow rates of the exhaust gases, the diameters of the respective tubes, and the total area of the perforations in the respective tubes. Varying any of these parameters can significantly affect the noise attenuation and flow characteristics of the prior art muffler.

In many situations, the above described carefully engineered tuning leaves one or more residual frequencies that are not properly attenuated. These residual frequencies typically are attenuated by the combination of tuning tubes and an enclosed resonating chamber. One end of the tuning tube may communicate with a reversing chamber in the muffler, while the opposed end of the tuning tube communicates with the resonating chamber. The diameter and legnth of the tuning tube and the volume of the resonating chamber are carefully engineered to attenuate one of the residual frequencies.

In certain instances, the tuning tube and resonating chamber cancel to some degree the initially observed residual frequency, but create a second and usually closely related residual frequency. Muffler designers have discovered that this shift of residual frequencies can often be eliminated by providing an aperture in one of the baffles defining the low frequency resonating chamber. These apertures cause the resonating chamber to attenuate a broader range of frequencies than the specific frequency dictated by the dimensions of the tuning tube and the resonating chamber.

The above described prior art exhaust muffler requires a substantial number of separate parts which require a corresponding high number of manufacturing steps, many of which are not well suited to automation. As a result, most prior art muffler manufacturing has been labor intensive.

Attempts have been made to manufacture exhaust mufflers from two shells stamp formed to define a circuitous path through which the exhaust gases must travel. These types of prior art stamp formed mufflers are shown in U.S. Pat. No. 2,484,827 which issued to Harley and U.S. Pat. No. 3,638,756 which issued to Thiele.

Certain other stamp formed mufflers have a plurality of plates, including internal plates stamp formed to define perforated tubular passages and external shells stamp formed to surround and enclose the perforated tubular passages. For example, British Pat. No. 632,013, which issued in 1949, shows internal plates stamp formed to define a circuitous array of perforated tubes, and a pair of external shells stamp formed to define an enclosure around the internal plates. British Pat. No. 1,012,463, which issued in 1965, shows a similar muffler; however, certain portions of the internal plates are stamp formed to define hinged flaps which are rotated out of the plane of the plate to define internal baffles. Additionally, the internal plates of the muffler shown in British Pat. No. 1,012,463 shows a plurality of stamp formed perforated tubes and stamp formed apertures in proximity to the tubes. U.S. Pat. No. 4,132,286 which issued to Hasui et al on Aug. 25, 1977 shows a stamp formed muffler very similar to the muffler shown in British Pat. No. 1,012,463. However, U.S. Pat. No. 4,132,286 further shows a single tube having an array of apertures or shunts at an upstream location and having a stamp formed taper to reduce the diameter at a downstream location. The relative sizes of the upstream shunts and the downstream reduced diameter portions are selected to vary the relative flows through the upstream shunts and the downstream apertures. These prior art stamp formed mufflers have attempted to model the outer shell mufflers, and thus included tubular portions spaced inwardly from the external shells.

Until very recently, stamp formed mufflers did not provide the complex flow patterns and the carefully engineered tuning that had been achieved with the prior art wrapped outer shell mufflers having separate internal tubular components and baffles. However, U. S. patent application Ser. No. 934,642, filed Nov. 25, 1986, which is entitled "STAMP FORMED MUFFLER" by Jon Harwood and which is assigned to the assignee of the subject application shows a muffler having all of the desirable attributes of stamp forming while still achieving the precisely engineered tuning. The muffler shown in application Ser. No. 934,642 includes at least one expansion chamber in communication with perforated tubes, and at least one low frequency resonating chamber in communication with a tuning tube.

Despite the many advantages of the muffler shown in Ser. No. 934,642, it has been found that certain mufflers having a plurality of closely spaced expansion chambers and/or low frequency resonating chambers connected by stamp formed tubes could often require excessive deformations of the metal. With certain types of metals, such as 0.034 inch thick stainless steel, the extreme deformations that were believed to be required to create expansion chambers and resonating chambers would result in unacceptably high reject rates. The reject rates were primarily caused by ruptures of the metal during the stamp forming operation, and typically occurred where the tubular portions extended between closely spaced chambers. Additionally, despite the many advantages of the muffler shown in Ser. No. 934,642, it was considered desirable to improve even further upon the tuning capabilities of stamp formed mufflers, and to enhance the strength and acoustical insulation of stamp formed mufflers.

In view of the above, it is an object of the subject invention to provide a muffler that can be manufactured with high reliability and quality.

Another object of the subject invention is to provide a stamp formed muffler that reduces the amount of metal deformation required to create separate expansion chambers and/or low frequency resonating chambers.

An additional object of the subject invention is to provide a muffler having at least one low frequency resonating chamber that is adapted to substantially soften a narrow range of objectionable low frequency noise.

A further object of the subject invention is to provide a muffler that achieve a carefully controlled cross flow of exhaust gases between two or more tubular members.

Still another object of the subject invention is to provide a formed muffler of enhanced strength.

SUMMARY OF THE INVENTION

The subject invention is directed to a muffler which comprises a pair of plates that are formed to define an array of tubes through which exhaust gases may travel. The array of tubes comprises at least one inlet which may be connected to at least one exhaust pipe of a vehicle, and at least one outlet which may be connected to at least one tail pipe of a vehicle. Selected portions of the array of tubes are provided with perforations through which exhaust gases may flow.

The muffler of the subject invention further comprises at least one external shell that is dimensioned and formed to enclose at least portions of an external plate. Additionally, the external shell is formed to define a plurality of chambers. In particular, the external shell may be formed to define an expansion chamber which surrounds and substantially encloses portions of an internal plate formed with perforations. Thus, exhaust gases flowing through the array of tubes defined by the formed internal plate may communicate with the chamber surrounding and enclosing perforations of the internal plate. The forming of the external shell may define a plurality of such expansion chambers of different respective volumes.

The external shell may further be formed to define a reversing chamber which is substantially isolated from the other formed chambers of the external shell and which communicates with a plurality of tubes defined by the formed plates. For example, an inlet tube formed in the plates may terminate at an aperture which is surrounded by a reversing chamber of the external shell. Similarly, a return tube defined by the forming of the plates may also terminate at an aperture disposed in the reversing chamber. In this typical example, the exhaust gases will flow from the exhaust pipe of the vehicle, through the inlet tube formed in the plates, into the reversing chamber defined by the formed external shell and then into the return tube formed in the plates. The external shell may further be formed to define a low frequency resonating chamber which is completely or substantially isolated from the other chambers of the external shell, and which communicates with a tuning tube defined by the forming of the plates.

In the typical embodiment explained in detail below, the plates and the external shells will be metal that is stamp formed into the specified configuration. However, it is also envisioned that the muffler described herein may be a high temperature plastic, and that the specified configuration may be achieved by molding.

The various chambers that may be defined by the forming of the external shell are completely or substantially isolated from one another. This isolation of one chamber of the external shell from the next may be achieved by forming the external shell such that portions thereof between adjacent chambers will lie substantially in abutting relationship with the plate adjacent thereto. If necessary, these portions of the external shell disposed in abutting relationship with a plate may be welded or otherwise affixed thereto to prevent vibrations and associated noises. In embodiments where complete isolation of two adjacent chambers is not desirable, the portion of the external shell between adjacent chambers may be formed to lie a selected distance from the facing surface of the adjacent plate.

Despite the need to at least substantially isolate adjacent chambers from one another, it is necessary to enable the tubes formed in the plates to pass between adjacent chambers. This is accomplished by forming the portions of the external shell between adjacent chambers with channels that are disposed and dimensioned to closely engage the portions of the formed tubes passing from one chamber to the next. In the typical situation, both the tubes stamp formed in the plates and the channels connecting the chambers of the external shell will be generally semicircular in cross section.

To enhance strength and reliability, the channels formed in the external shell may define continuous extensions of peripheral portions of the adjacent chambers between which the channels are to extend. Accordingly, selected portions of the tubes stamp formed in the plates may be disposed to be closely engaged by the channels. As a result of this configuration, the external shell of the muffler will have a substantially reduced number of convolutions formed therein with a correspondingly decreased likelihood of overstressing and weakening the material during the stamp forming of metallic versions of the muffler. The resulting product achieves a very low reject rate during manufacture and yields a product having greater strength. More particularly, the substantial face to face contact between the external shell and the plate at the peripheral portions of adjacent chambers will effectively reinforce the upstanding walls of the chambers, thus making accidental deformation unlikely. This construction also maximizes the distance between perforated tubes within an expansion chamber of the external shell.

In embodiments where a perforated tube will lie in face to face contact with a peripheral portion of a chamber, the perforated portions of the tube will lie only on a longitudinally extending portion that is not in direct face to face contact with the external shell. In one embodiment, two formed tubes passing through an expansion chamber will be disposed at extreme opposite sides of the chamber and in abutting contact with opposed peripheral walls defining the formed chamber. Each of these formed tubes within the expansion chamber may be provided with an array of perforations formed therein along the longitudinally extending portions that are nearest to one another. This perforation pattern is believed to further one another. This perforation pattern is believed to further enhance the cross flow of exhaust gases from one perforation array to the next.

The relative flow rates of exhaust gases either through the tubular passages stamp formed in the plates or alternatively through the perforations and expansion chambers, may be controlled by stamp forming the plates to have at least one tube of varying cross section along its respective length. Preferably, a plurality of perforated tubes will be formed to have varying cross-sectional dimensions along their respective lengths. The variation in the cross-sectional dimensions of the tube preferably will occur either upstream or downstream of a perforation array. For example, a reduction in cross-sectional dimension immediately downstream of a perforation array in a formed tube will urge a greater proportion of the exhaust flow out of the perforations. Alternatively, an outlet tube or return tube may have an entrance of reduced diameter and a larger diameter portion along which a perforation array is disposed.

In embodiments where formed tubes will be disposed in abutting relationship to formed chambers of the external shell, the tube may be asymmetrical such that the tube will have one continuous edge substantially adjacent walls of the external shell chambers, but will have discontinuous portions to achieve the dimensional changes. Thus, one side of a formed tube may be continuous and substantially straight, while the opposite side will be discontinuous to achieve the required cross-sectional changes. These variations in tube diameter may also be employed to achieve the required perforation area along a selected length of stamp formed tubes. In particular, this may be necessary on embodiments where a portion of the formed tube will lie in face to face contact with a formed chamber of the external shell and where the perforations will be disposed only along longitudinally extending portion.

BRIEF DESCRIPTION OF THE DRAWINGS

FIG. 1 is a perspective view of a muffler in accordance with the subject invention.

FIG. 2 is an exploded perspective view of the muffler shown in FIG. 1.

DETAILED DESCRIPTION OF THE PREFERRED EMBODIMENT

Figure 3:
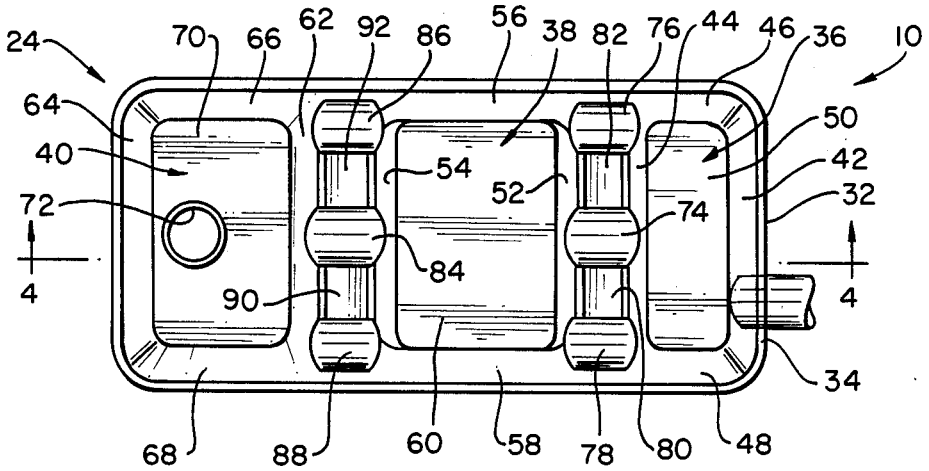
FIG. 3 is a top plan view of the muffler shown in FIG. 1.
Figure 4:
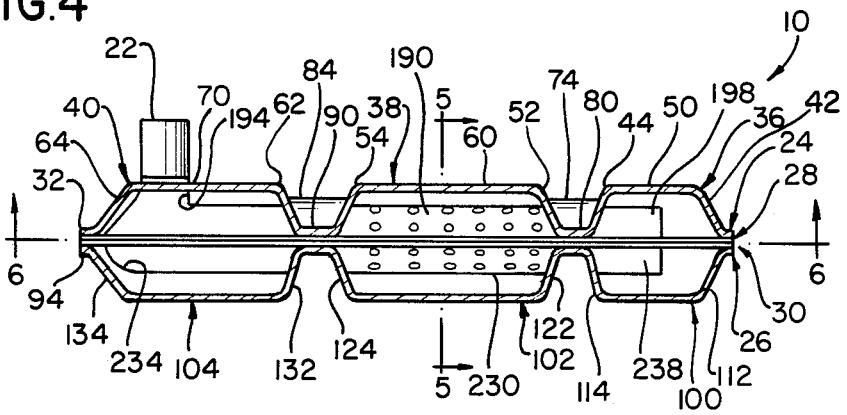
FIG. 4 is a cross-sectional view taken along line 4—4 in FIG. 3.
Figure 5:
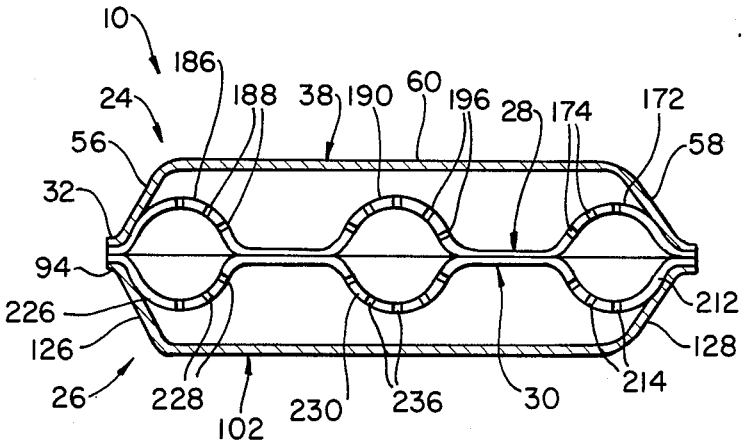
FIG. 5 is a cross-sectional view taken along line 5—5 in FIG. 4.
Figure 6:
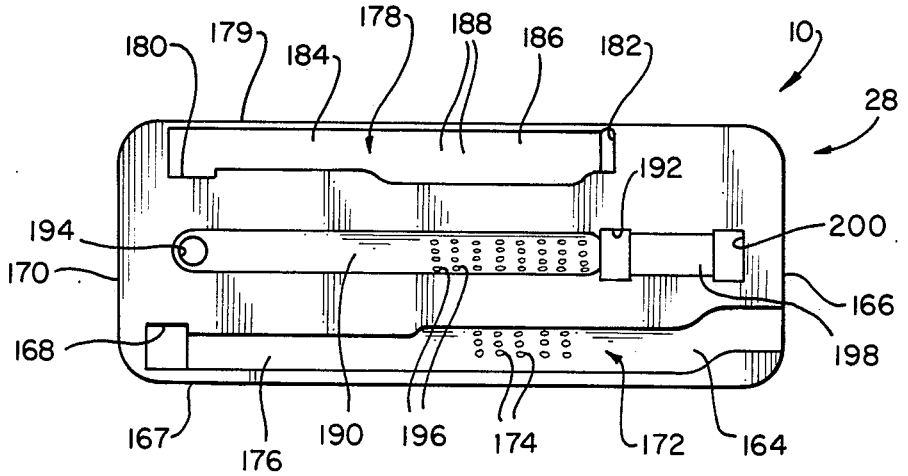
FIG. 6 is a cross-sectional view taken along line 6—6 in FIG. 4.

A muffler in accordance with the subject invention is illustrated in FIGS. 1–6, and is identified by the numeral 10. As shown in FIG. 1, the muffler 10 is an elongated structure having a pair of opposed longitudinally extending sides 12 and 14 and a pair of opposed ends 16 and 18. An inlet pipe 20 is connected to a portion of end 16 in proximity to the longitudinal side 12. The inlet pipe 20 extends from the engine of the vehicle to which the muffler 10 is mounted. An outlet pipe 22 extends from a portion of muffler 10 between the opposed longitudinally extending sides 12 and 14 generally in proximity to the end 18 of muffler 10. The outlet pipe 22 is angularly aligned with respect to the exhaust pipe 20. The inlet pipe 20 and the outlet pipe 22 will be in communication with an array of generally tubular members defined by stamp formed plates on the inside of muffler 10, as explained in detail below. In some embodiments, the tubular members 20 and 22 may define short inlet and outlet nipples which are connected to the exhauast pipe and the tail pipe of the vehicle respectively.

As shown most clearly in FIG. 2, the muffler 10 includes a pair of external shells 24 and 26 and a pair of internal plates 28 and 30, all of which preferably are stamp formed from metal, but which may be molded or ohterwise formed from plastic. In general, the internal plates 28 and 30 are stamp formed to define an array of the tubes which will carry exhaust gases through the muffler 10. The external shells 24 and 26, on the other hand, define chambers which cooperate with the tubes stamp formed in internal plates 28 and 30 to peform various noise attenuating functions within the muffler 10.

The external shell 24 is stamp formed to include a peripheral flange 32. The peripheral flange 32 is generally planar, but is stamp formed to include a peripheral arcuate portion 34 which will engage the exhaust pipe 20 of the muffler.

The stamp forming of the external shell 24 further defines a low frequency resonating chamber 36, an expansion chamber 38 and a reversing chamber 40. The low frequency resonating chamber 36 is defined in part by a pair of generally opposed end walls 42 and 44 and a pair of opposed generally longitudinally extending side walls 46 and 48. The end wall 42 and the side walls 46 and 48 intersect the peripheral flange 32 at an angle of between about 40°–80°, and preferably about 60°. A top wall 50 joins the end walls 42 and 44 and the side walls 46 and 48.

The expansion chamber 38 is spaced from the low frequency resonating chamber 36 and is defined by opposed end walls 52 and 54 and opposed generally longitudinally extending side walls 56 and 58 which extend angularly from the peripheral flange 32. A top wall 60 joins the end walls 52 and 54 and the side walls 56 and 58, and may be characterized by a stiffening embossment 61 stamp formed therein.

The reversing chamber 40 similarly is defined by opposed end walls 62 and 64 and opposed generally longitudinally extending side walls 66 and 68. The end wall 64 and side walls 66 and 68 extend angularly from peripheral flange 32. A top wall 70 extending between the end walls 62 and 64 and the side walls 66 and 68 is provided with an aperture 72 through which the outlet pipe 22 will extend. The various walls defining the chambers 36–40 may be generally planar or generally arcuate.

As noted above, the low frequency resonating chamber 36, the expansion chamber 38 and the reversing chamber 40 typically are intended to be substantially isolated from one another. However, the tubes stamp formed in the internal plates 28 and 30 must pass from one chmber to the next. As a result, the external shell 24 is provided with channels 74, 76 and 78 extending the low frequency resonating chamber 36 and the expansion chamber 38. Between the channels 74, 76 and 78 are generally planar portions 80 and 82 which lie generally in the same plane as the peripheral flange 32 or slightly out of the plane of peripheral flange 32 to create a slight preload against the internal plate 28 as the muffler is assembled. Similarly, channels 84, 86 and 88 extend between the expansion chamber 38 and the reversing chamber 40. Generally planar portions 90 and 92 are disposed between the channels 84, 86 and 88 and lie generally in the same plane as the peripheral flange 32 or slightly out of the plane of peripheral flange 32 to create a slight preload against the internal plate 28 as the muffler is assembled. The channel 76 extends out of the plane defined by peripheral flange 32 along a line that is generally continuous with the intersections of the side walls 46 and 56 with the peripheral flange 32. Thus, the portion of the channel 76 adjacent the peripheral flange 32 lies substantially in a generally common continuous surface with the side walls 46 and 56 of the low frequency resonating chamber 36 and the expansion chamber 38 respectively. Similarly, the channel 86 and the side walls 56 and 66 are stamp formed to extend from the peripheral flange 32 along a generally continuous line. Thus, the portion of channel 86 adjacent the peripheral flange 32 lies in substantially the same generally continuous surface as the side walls 56 and 66.

In a similar manner, the channels 78 and 88 are stamp formed to extend from the peripheral flange 32 along lines that are generally continuous with the extensions of side walls 48, 78 and 88 from the peripheral flange 32. Thus, the portions of the channels 78 and 88 adjacent the peripheral flange 32 will be generally continuous with the side walls 48, 58 and 68.

In the embodiment of the muffler 10 illustrated in FIGS. 1–6, the external shell 26 is very similar to the above described external shell 24. However, symmetry or similarity is not at all required. In certain embodiments, the external shells 24 and 26 will be noticeably different from one another to accommodate various space limitations on the vehicle. Additionally, in certain instances, it may be desirable to provide a substantially continuous streamlined surface for the external shell 26 to reduce air resistance or drag that may be created by the muffler 10. As illustrated in FIG. 2, however, the external shell 26 includes a peripheral flange 94 which is generally planar and is dimensioned to be placed in register with the peripheral flange 32 of external shell 24. Additionally, the peripheral flange 94 is characterized by an arcuate portion 96 which is disposed to be in register with the arcuate portion 34 to define the inlet to the muffler 10. The external shell 26 is further stamp formed to define a low frequency resonating chamber 100, an expansion chamber 102 and a reversing chamber 104. The low frequency resonating chamber 100 is defined by opposed end walls 112 and 114 and opposed generally longitudinally extending side walls 116 and 118. Similarly, the expansion chamber 102 is characterized by opposed end walls 122 and 124 and opposed generally longitudinally extending side walls 126 and 128. The reversing chamber 104 is defined by opposed end walls 132 and 134 and opposed generally longitudinally extending side walls 136 and 138. The reversing chamber 104 has no outlet aperture comparable to the outlet aperture 72 in the reversing chamber 40 of the external shell 24.

Channels 144, 146 and 148 extend between the low frequency resonating chamber 100 and the expansion chamber 102. Planar portions 150 and 152 are disposed between the channels 144–148 and lie generally in the same plane as the peripheral flange 94 or sufficiently out of the plane to create a preload against internal plate 30 during assembly. Similarly, channels 154, 156 and 158 extend between the expansion chamber 102 and the reversing chamber 104. The planar portions 160 and 162 between the channels 154–158 lie generally in the same plane as the peripheral flange 94 or slightly out of the plane as explained above. The walls 116, 126 and 136 and the channels 146 and 156 extend out of the plane of the peripheral flange 94 along a substantially continuous line. Similarly, the walls 118, 128 and 138 and the channels 148 and 158 extend from the peripheral flange 94 along a substantially continuous line. As will be explained further below, the channels 144–148 and 154–158 are disposed to engage tubes stamp formed in the internal plate 30. Similarly, the planar portions 150, 152, 160 and 162 between the arcuate channels will generally lie substantially in face to face contact with corresponding portions of the internal plate 30.

The internal plate 28 is stamp formed to define an inlet tube 164 which extends from end 166 of the stamp formed internal plate, generally in a longitudinal direction. The major portion of the inlet tube 164 is disposed to be substantially in line with the channels 78 and 88 of the external shell 24. However, the portion of the inlet channel 164 adjacent end 166 is disposed in a more central lateral position which facilitates the stamp forming of the flange 32 and the arcuate portion 34 on the external shell 24. The inlet channel 164 terminates at an aperture 168 which is in proximity to the opposed end 170 of the stamp formed internal plate 28. The aperture 168 is disposed to lie within the reversing chamber 40 stamp formed in the external plate 24. The inlet channel 164 is further characterized by a large diameter portion 172 which is stamp formed to include an array of perforations 174. The perforations 174 are disposed to lie within the expansion chamber 38 of the external shell 24. The perforations 174 are disposed along a longitudinally extending portion of the inlet channel 164 generally opposite the side edge 167 of internal plate 28. The inlet channel 164 further includes a reduced diameter portion 176 disposed between the larger diameter portion 172 and the aperture 168. The cross-sectional areas of the portions 172 and 176 of the inlet channel 164 respectively and the total area of the perforations 174 are selected to control the relative proportion of exhaust gases traveling entirely through the exhaust channel 164 to aperture 167 with the portion of the exhaust gases that will flow outwardly through the perforations 174.

A return channel 178 extends generally parallel to and slightly spaced from the side edge 179. More particularly, the return channel extends from aperture 180 which is in proximity to end 170 to aperture 182 which is in proximity to end 166. The aperture 180 is disposed to lie within the reversing chamber 40 of external shell 24, while the aperture 182 is disposed to lie within the expansion chamber 38 of the external shell 24. The return channel 178 includes a small diameter portion 184 adjacent the aperture 180 and a large diameter portion 186 adjacent the aperture 182. The large diameter portion 186 is provided with perforations 188 that are disposed to lie within the tuning chamber 38 of the external shell 24. The perforations 188 are disposed along a longitudinal portion of the return channel 178 opposite the side 179 of the internal plate 28. As explained previously, the total area encompassed by the perforations 188 is selected to achieve a preferred ratio between the exhaust gases flowing entirely through the return channels 178 with the exhaust gases flowing through the perforations 188. An outlet channel 190 extends from aperture 192 to outlet aperture 194. The aperture 192 is disposed to lie within the expansion chamber 38 of the external shell 24, while the outlet aperture 194 is disposed to be in register with the outlet aperture 72 in the external shell 24. The outlet channel 190 is provided with an array of perforations 196, the total area of which is selected to achieve a selected ratio between the exhaust gases that will flow longitudinally the entire distance through the outlet channel 190, as opposed to those exhaust gases that will enter in a generally radially inward direction through the perforations 196. This ratio is further controlled by stamp forming the portion of outlet channel 190 adjacent aperture 192 to have a cross-sectional area smaller than the downstream portion of outlet channel 190 adjacent perforations 196.

The internal plate 28 is further stamp formed to define a tuning channel 198 that extends from aperture 192 to an aperture 200. The aperture 200 is disposed to lie within the low frequency resonating chamber 36 stamp formed in the external shell 24. The length and cross-sectional area of the tuning channel 198 is selected to attenuate a particular narrow range of frequencies of sounds.

The internal plate 30 is stamp formed in a manner similar to the internal plate 28. In particular, the internal plate 30 includes an inlet tube 204 terminating at an aperture 208 which is disposed to lie within the reversing chamber 104 of external shell 26. The inlet tube 204 includes a large diameter portion 212 having perforations 214 along an inwardly facing longitudinally extending portion which will lie within the expansion chamber 102 of the external shell 26. The inlet channel 204 further includes a small diameter portion 216 which extends between the large diameter portion 212 and the aperture 208. A return tube 218 extends from an aperture 220 to an aperture 222. The aperture 220 is disposed to lie within the reversing chamber 104, while the aperture 222 is disposed to lie within the expansion chamber 102. The portion of the return channel 218 adjacent the aperture 220 defines a small diameter portion 224, while the portion of the return channel 218 adjacent the aperture 222 defines a large diameter portion 226. The large diameter portion 226 includes an array of perforations 228 along an inwardly facing longitudinally extending portion that will lie within the tuning chamber 102. As explained previously, the area encompassed by the perforations 228 will control the amount of exhaust flow therethrough. An outlet tube 230 extends from an aperture 232 which is disposed to lie within the expansion chamber 102. The outlet tube terminates at location 234 which is disposed to be substantially in register with the outlet aperture 194 in the internal plate 28. The outlet aperture 230 includes an array of perforations 236 extending substantially entirely thereabout. Internal plate 30 further includes stamp formed tuning channel 238 which extends from aperture 232 to aperture 240 which is disposed to lie within the low frequency resonating chamber 100.

The muffler 10 is assembled by suitably joining the internal plates 28 and 30 to one another by mechanical staking, spot welding or the like, such that the channels stamp formed therein define an array of stamp formed tubes. The external shells 24 and 26 then are positioned around the connected internal plates 28 and 30 and are secured in position by welding or mechanical connection along the peripheral flanges 32 and 94. The portions between adjacent chambers of the external shells 24 and 26 preferably are biased against the internal plates 28 and 30 as the peripheral flanges are joined. Additionally, the portions between the chambers of the external shells 24 and 26 may be secured to the internal plates by spot welding, mig welding or such. Such connection of the external shell 24 and 26 to the internal plates 28 and 30 provides added strength and rigidity and enhances backfire resistance. As shown most clearly in FIG. 5, the perforation arrays 174, 188, 196, 214, 228 and 236 stamp formed in the internal plates 28 and 30 will lie within the expansion chambers 38 and 102 which are in register with one another. Similarly, the tuning channels 198 and 238 will define a tuning tube which will terminate in the registered low frequency resonating chambers 36 and 100. Additionally, the channels 76–78, 86–88, 146–148 and 156–158 will engage portions of the inlet channels 164 and 204 and the return channels 178 and 218. Portions of the inlet channel 164 will abut portions of side walls 48, 58 and 68 of external shell 24, while portions of return channel 178 will abut side walls 46, 56 and 66 of the external shell 24. Similarly, in the assembled condition of muffler 10, portions of the inlet channel 204 will abut portions of the side walls 118, 128 and 138 of external shell 26, while portions of the return channel 218 will abut portions of side walls 116, 126 and 136 of the external shell 26. This abutting relationship between the chamber walls of the external shells and the channels of the internal shells enhances the strength of the muffler 10.

Exhaust gases will enter the assembled muffler 10 through the inlet nipple 20 and will flow through the inlet tube defined by channels 164 and 204. A proportion of the exhaust gases will flow the entire distance through the inlet tube formed by channels 164 and 204 to enter the reversing chambers 40 and 104. However, some exhaust gases will flow out through the perforations 174 and 214 to enter the expansion chambers 38 and 102. This relative distribution will depend upon the total area encompassed by the perforations 174 and 214 and the relative reductions in cross-sectional area along the length of the inlet tube formed by channels 164 and 204. The exhaust gases entering the reversing chambers 40 and 104 will enter the return tube formed by channels 178 and 218 at apertures 180 and 220. Some of these exhaust gases will flow the entire distance to the apertures 182 and 222, while another proportion will exit through perforations 188 and 228 to enter the expansion chambers 38 and 102. The exhaust gases will then enter the outlet tube formed by channels 190 and 230 either at apertures 192 and 232 or at the perforations 196 and 236. The exhaust gases will continue to the outlet aperture 72 and to the outlet pipe 22. As the exhaust gases move through the expansion chambers 38 and 102, the tuning tube defined by channels 198 and 238 and the resonating chambers 36 and 100 will perform tuning on a certain narrow range of frequencies.

Figure 7:
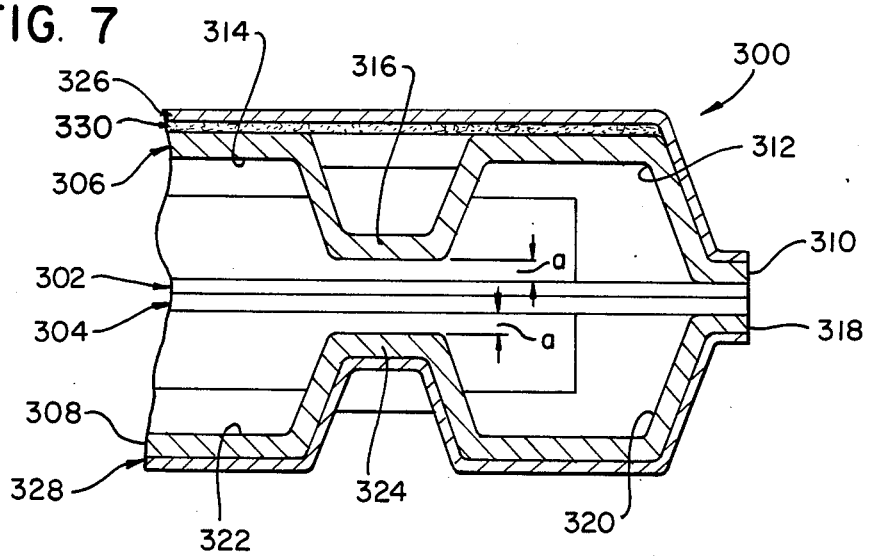
FIG. 7 is a cross-sectional view similar to FIG. 4, but showing a different embodiment.

A different embodiment of the muffler 10 is illustrated in FIG. 7 and is identified generally by the numeral 300. In particular, the muffler 300 includes internal plates 302 and 304 that are substantially identical to the internal plates described in the embodiments of FIGS. 1–6. The muffler 300 further includes stamp formed external shells 306 and 308 which are similar to the external shells 24 and 26 of the previously described embodiment. In particular, the external shell 306 includes a peripheral flange 310, a low frequency resonating chamber 312, and an expansion chamber 314. Between the low frequency resonating chamber 312 and the tuning chamber 314 is a planar portion 316.

Similarly, the external shell 308 is stamp formed to define a peripheral flange 318, a low frequency resonating chamber 320 and an expansion chamber 322. A planar portion 324 is disposed between the low frequency resonating chamber 320 and the expansion chamber 322. However, unlike the previously described embodiment, the planar portions 316 and 324 do not lie within the same plane as the respective peripheral flanges 310 and 318. Rather, the planar portions 316 and 324 will be spaced from the stamp formed internal plates 302 and 304 by a preselected distance "a" to achieve controlled leakage of exhaust gas from the low frequency resonating chambers 312 and 320 and to soften the tuning effect of the low frequency resonating chambers 312 and 320. In the typical situation, the planar portions 316 and 324 will be spaced from the corresponding internal plates 302 and 304 by approximately 0.1–0.5 inch.

The muffler 300 further includes stamp formed insulating shells 326 and 328. As illustrated in FIG. 7, the stamp formed insulating shells 326 and 328 have substantially the same shape as the external shells 306 and 308 respectively. However, in the preferred embodiment the insulating shells 326 and 328 will be formed from a thinner material. The insulating shells 326 and 328 can be stamp formed on the same stamping apparatus and merely placed over the corresponding external shells 306 and 308. The insulating shells 326 and 328 perform both noise and heat insulation and contribute to the structural support of the muffler 300. An insulating material 330 may be disposed between the insulating shell 326 and the external shell 306.

In summary, a stamp formed muffler is provided including a pair of internal plates stamp formed to define an array of tubes through which exhaust gases may flow. The muffler further includes at least one external shell stamp formed to define a plurality of chambers to be placed in communication with the exhaust gases traveling through the muffler. The tubes stamp formed in the internal plates pass between adjacent chambers defined by the external shells. Thus, the external shells further include channels corresponding in shape to the tubes of the internal plates. The channels between adjacent chambers of each external shell are disposed to extend continuously between peripheral portions of each adjacent external shell. The tubes stamp formed in the internal plates will then be disposed to lie within the corresponding channels. In particular, longitudinally extending portions of at least one stamp formed tube will lie substantially in abutting relationship to peripheral walls of selected chambers stamp formed in the external shell, thereby contributing to the rigidity of the muffler. The tubes may further be provided with variations in cross-sectional area in proximity to portions having perforation arrays to carefully control the relative proportions of exhaust gases flowing in a longitudinal direction with the proportion flowing outwardly or inwardly through the perforations. The reductions in the diameters of stamp formed tubes to lie adjacent walls of the chambers preferably take place along portions of the tubes generally opposite and spaced from the abutting walls of the chambers. Additionally, the perforations through these tubes are disposed along longitudinally extending sections spaced from the portions of the tube that abut the walls of the chambers in the external shell. In certain embodiments, the stamp forming of the external shell provides a controlled communication between low frequency resonating chambers and adjacent chambers. Additionally, in certain embodiments, additional external insulating shells and provided to reduce vibration related noise and to provide additional heat insulation.

While the invention has been described with respect to certain preferred embodiments, it is apparent that various changes can be made without departing from the scope of the invention as defined by the appended claims.

What is claimed is:

1. An exhaust muffler comprising at least one external shell formed to define an inlet to the muffler, an outlet from the muffler and a plurality of chambers, each said chamber comprising at least one peripheral side wall, at least one channel extending between said chambers, said channel being disposed such that portions of said channel are generally aligned with portions of the peripheral side walls of the chambers between which said channel extends, said muffler further comprising a pair of plates disposed in face to face relationship and rigidly connected to said formed external shell, said plates being formed to define at least one tube therebetween, said tube being in communication with the inlet and the outlet and being disposed to be engaged by said channel, longitudinally extending portions of said tube being substantially in face to face contact with portions of said peripheral side walls of said chambers, whereby the relative positions of said tube, said channel and said peripheral side walls substantially avoid overstressing the external shell.

2. A muffler as in claim 1 wherein at least one said plate is formed to define perforations extending through said tube, said perforations being disposed along a longitudinally extending portion of said tube spaced from said peripheral walls of said chambers.

3. A muffler as in claim 1 wherein portions of said external shell intermediate said chambers are biased against the plate adjacent thereto.

4. A muffler as in claim 1 wherein portions of said external shell intermediate said chambers are fixedly attached to the plate adjacent thereto.

5. A muffler as in claim 4 wherein the fixed attachment is by welding.

6. A muffler as in claim 1 comprising a pair of formed external shells, said external shells being fixedly connected to and substantially surrounding said plates.

7. A muffler as in claim 3 wherein the portions of each said external shell between the chambers therein are disposed substantially in face to face contact with one of said plates.

8. A muffler as in claim 1 wherein said plates are formed to define a plurality of tubes in communication with one another, at least one said tube defining a tuning tube, and wherein at least one said chamber defines a low frequency resonating chamber, said tuning tube being in communication with said low frequency resonating chamber.

9. A muffler as in claim 8 wherein the portion of said external shell between said low frequency resonating chamber and at least one other of said chambers is spaced from said formed plates to achieve controlled leakage of exhaust gases from said low frequency resonating chamber to the chamber adjacent thereto.

10. A muffler as in claim 9 wherein the portion of said external shell between said low frequency resonating chamber and the chamber adjacent thereto is spaced from said plates by a distance of less than approximately 0.5 inch.

11. A muffler as in claim 1 further comprising a formed insulating shell disposed substantially in face to face contact with at least portions of said external shell.

12. A muffler as in claim 1 wherein a portion of said tube is spaced from said peripheral wall and includes an array of perforations extending therethrough, and wherein a portion of said tube adjacent said array of perforations is of reduced cross-sectional area.

13. A muffler as in claim 12 wherein the reduction in cross-sectional area of said tube is achieved by a discontinuity along the longitudinally extending portion of said tube spaced from said peripheral wall.

14. A muffler comprising a pair of formed external shells and a pair of formed internal plates, each said external shell being formed to define an inlet to the muffler, an outlet from the muffler and a plurality of chambers with each said chamber including a pair of generally opposed side walls, the side walls of one said chamber being generally aligned with the side walls of the other chamber, each said external shell further comprising a pair of formed channels extending between said chambers such that a portion of each said channel is generally aligned with and extends between the aligned walls of said chambers, said internal plates being formed to define at least two tubes therebetween, said tubes being in communication with the inlet and the outlet, and being disposed to be engaged respectively by said channels, and being disposed such that portions of each of said tubes are disposed generally in face to face relationship with one of said side walls of each said chamber, whereby the relative positions of said tube, said channel and said side walls substantially avoid overstressing the external shell.

15. A muffler as in claim 14 wherein portions of the tubes in one said chamber are formed to define perforations therein.

16. A muffler as in claim 15 wherein the perforations are disposed along longitudinally extending portions of said tubes spaced from said side walls of said chambers.

17. A muffler as in claim 16 wherein each said tube comprises a large cross-sectional area portion and a small cross-sectional area portion, said perforations extending through the large cross-sectional area portion.

18. A muffler as in claim 14 wherein portions of said external shell intermediate said chambers and said channels are biased against the plate adjacent thereto.

19. A muffler as in claim 14 wherein portions of said external shell intermediate said chambers and said channels are fixedly attached to the plate adjacent thereto.

20. A muffler as in claim 19 wherein the fixed attachment is by welding.

21. A muffler as in claim 14 wherein at least one of said tubes formed between said internal plates defines a tuning tube and wherein at least one said chamber defines a low frequency resonating chamber, said tuning tube being in communication with said low frequency resonating chamber, and wherein a portion of at least one of said external shells between said low frequency chamber and at least one other of said chambers is spaced from said internal plates to achieve controlled leakage of exhaust gases from said low frequency resonating chamber to the chamber adjacent thereto.

22. An exhaust muffler comprising:

a pair of formed internal plates disposed in generally face to face relationship, said internal plates being formed to define an array of tubes therebetween, said array of tubes comprising an inlet to the muffler and an outlet from the muffler;

a pair of formed external shells securely connected to and surrounding said internal plates, said external shells being formed to define a plurality of chambers in communication with said tubes of said internal plates; and at least one insulating shell formed to generally surround one of said external shells and being securely connected thereto.

23. An exhaust muffler in claim 22 wherein said insulating shell is disposed in face to face contact with at least a portion of one of said external shells.

24. An exhaust muffler as in claim 22 wherein a portion of said insulating shell is spaced from said external shells to define a space therebetween.

25. An exhaust muffler as in claim 22 further comprising insulating material between said insulating shell and said external shell.

26. An exhaust muffler as in claim 22 wherein at least one of said chambers defines a low frequency resonating chamber, and wherein at least one of said tubes defines a tuning tube in communication with said low frequency resonating chamber, and wherein a portion of at least one of said external shells intermediate said low frequency resonating chamber and another of said chambers of said external shells adjacent to said low frequency resonating chamber is spaced from said internal plates to achieve controlled leakage of exhaust gases from said low frequency resonating chamber to the chamber adjacent thereto.

* * * * *